US009150283B2

(12) United States Patent
Braaten-Boyd

(10) Patent No.: US 9,150,283 B2
(45) Date of Patent: Oct. 6, 2015

(54) COLLAPSIBLE COVER FOR A KAYAK

(71) Applicant: Nancy Lee Braaten-Boyd, Geneseo, NY (US)

(72) Inventor: Nancy Lee Braaten-Boyd, Geneseo, NY (US)

( * ) Notice: Subject to any disclaimer, the term of this patent is extended or adjusted under 35 U.S.C. 154(b) by 0 days.

(21) Appl. No.: 14/169,673

(22) Filed: Jan. 31, 2014

(65) Prior Publication Data

US 2014/0211489 A1 Jul. 31, 2014

Related U.S. Application Data

(60) Provisional application No. 61/759,205, filed on Jan. 31, 2013.

(51) Int. Cl.

| | |
|---|---|
| ***B63B 17/00*** | (2006.01) |
| ***B63B 17/02*** | (2006.01) |
| *B63B 35/71* | (2006.01) |

(52) U.S. Cl.

CPC ..... *B63B 17/02* (2013.01); *B63B 2035/715* (2013.01)

(58) Field of Classification Search

CPC ..... B63B 17/02; B63B 2035/715
USPC ..... 114/343, 361, 364
See application file for complete search history.

(56) References Cited

U.S. PATENT DOCUMENTS

| | | | | |
|---|---|---|---|---|
| 2,280,729 | A | | 4/1942 | Sutton |
| 2,453,422 | A | * | 11/1948 | Ellsworth ..... 114/361 |
| 2,542,586 | A | | 2/1951 | Skjeveland |
| 2,559,421 | A | | 7/1951 | Garrett |
| 2,689,579 | A | * | 9/1954 | Sartori ..... 135/133 |
| 2,764,765 | A | | 10/1956 | Woodruff |
| 2,811,728 | A | | 11/1957 | Litsheim |
| 2,829,660 | A | * | 4/1958 | Wester et al. ..... 135/137 |
| 2,932,833 | A | * | 4/1960 | Wambach ..... 5/656 |
| 2,969,075 | A | * | 1/1961 | Girten ..... 135/132 |
| 3,059,659 | A | | 10/1962 | Ibsen |
| 3,106,931 | A | | 10/1963 | Cooper |
| 2,873,751 | A | | 2/1969 | Couse et al. |
| 3,491,388 | A | | 1/1970 | Bareis |
| 3,653,084 | A | | 4/1972 | Hartman |
| 3,870,875 | A | | 3/1975 | Altimus |
| 3,955,228 | A | | 5/1976 | Gaschenko et al. |
| 4,106,145 | A | * | 8/1978 | Gillen et al. ..... 114/351 |
| 4,191,991 | A | | 3/1980 | Sorlien |
| 4,440,187 | A | * | 4/1984 | Fiddler ..... 135/117 |
| 4,683,900 | A | * | 8/1987 | Carmichael ..... 135/88.01 |
| 5,215,109 | A | * | 6/1993 | Kent, Jr. ..... 135/137 |
| 5,636,916 | A | | 6/1997 | Sokolowski |
| 5,697,320 | A | * | 12/1997 | Murray ..... 114/361 |
| D392,243 | S | | 3/1998 | Anderson |
| 5,769,105 | A | | 6/1998 | Margol et al. |
| 6,065,421 | A | | 5/2000 | Haller et al. |
| 6,240,665 | B1 | | 6/2001 | Brown et al. |
| 6,550,575 | B2 | | 4/2003 | Spencer et al. |
| 6,672,241 | B2 | | 1/2004 | Warfel et al. |
| 6,883,931 | B2 | | 4/2005 | Tufte |

(Continued)

*Primary Examiner* — Daniel V Venne
(74) *Attorney, Agent, or Firm* — Woods Oviatt Gilman LLP; Katherine H. McGuire, Esq.

(57) ABSTRACT

A canopy apparatus for a kayak comprises a bracket configured to be mounted to a kayak deck and a canopy. The canopy has a base member adapted to engage the bracket to releasably secure the canopy to the kayak deck and a cover pivotally connected to the base member. The cover is selectively movable between collapsed and expanded positions. The forward edge of the cover may further be adapted to carry a plurality of lights, preferably LEDs.

11 Claims, 3 Drawing Sheets

(56) References Cited

U.S. PATENT DOCUMENTS

| | | | | |
|---|---|---|---|---|
| 6,883,944 | B2 | 4/2005 | LeBouef | |
| 7,021,235 | B1 | 4/2006 | Nikjewicz-Larsen | |
| 7,185,600 | B2 | 3/2007 | Toussi et al. | |
| 7,194,976 | B1 | 3/2007 | Kramer | |
| 7,303,452 | B1 | 12/2007 | Ertz, III et al. | |
| 7,424,862 | B1 * | 9/2008 | Wagner | 114/361 |
| 7,575,499 | B2 | 8/2009 | Tufte | |
| 7,651,250 | B2 | 1/2010 | Griffin | |
| 7,794,124 | B2 | 9/2010 | Hulsey et al. | |
| 7,946,741 | B2 | 5/2011 | Nichols | |
| 7,984,686 | B1 * | 7/2011 | Solorzano | 114/361 |
| 8,122,842 | B2 | 2/2012 | Gisborne | |
| D666,486 | S | 9/2012 | Czipri | |
| 8,277,098 | B2 | 10/2012 | Ortwein et al. | |
| 8,484,906 | B1 | 7/2013 | Tarr | |
| 2005/0268833 | A1 | 12/2005 | Conrad | |
| 2006/0005869 | A1 | 1/2006 | Kuelbs | |
| 2007/0137553 | A1 | 6/2007 | Murray | |
| 2012/0024218 | A1 | 2/2012 | Haller et al. | |
| 2013/0025528 | A1 | 1/2013 | Cooney | |
| 2013/0039081 | A1 | 2/2013 | Czipri et al. | |
| 2013/0061795 | A1 | 3/2013 | Zirkelbach et al. | |
| 2013/0206050 | A1 | 8/2013 | Russikoff | |

* cited by examiner

COLLAPSIBLE COVER FOR A KAYAK

CROSS-REFERENCE TO RELATED APPLICATIONS

This application claims the benefit of U.S. Patent Application No. 61/759,205 filed on Jan. 31, 2013.

FIELD OF THE INVENTION

The present invention relates to a canopy apparatus, and more particularly, to a canopy apparatus for use with a kayak. Specifically, the present invention relates to a collapsible canopy apparatus removably mounted on a kayak, the canopy being expandable to provide shade to a kayaker upon demand, collapsible when not needed and removable when the kayak is being transported.

BACKGROUND OF THE INVENTION

Kayaks are water-borne recreational vehicles and are generally comprised of a covered deck situated on a hull and generally include one or more cockpits for seating the kayaker/paddler. Propulsion, aside from river or ocean currents, and maneuverability of the kayak are typically controlled by the kayaker through the use of a double bladed paddle. When seated within the cockpit, the kayaker's head and torso generally extend above the surface of the covered deck. In this manner, the kayaker's arms are free to swing the paddle as desired/required for propulsion or turning. However, by projecting above the deck, the kayaker's head and torso are exposed to the elements.

Exposure to the elements may lead to dangerous conditions for a kayaker. In particular, kayakers (especially inexperienced recreational kayakers) are exposed to the sun for extended periods of time, often without realization. Besides the prolonged exposure to harmful ultraviolet (UV) rays which may lead to skin conditions such as sunburn or even skin cancer, this extended sun exposure can lead to more immediate adverse health effects such as dehydration, sunstroke/heatstroke or even more severe instances of hyperthermia.

To alleviate kayaker exposure to the sun, canopy devices have been designed and implemented. However, a number of these designs necessitate rigidly securing a canopy frame to the body of the kayak with a cloth covering subsequently secured to that frame. While these designs satisfactorily provide shade, these devices also generate a number of significant drawbacks. First, the rigid frame is generally time-consuming to assemble and mount to the kayak deck (and similarly time-consuming to dismount and disassemble after use). These frames also generally require the use of tools and other hardware for proper mounting and structural support. Second, these frames tend to be bulky and disrupt the weight and balance of the kayak such that the kayak is unable to perform as efficiently or as safely as originally provided by the kayak's designer. Third, the canopy cover material often used to provide the desired shade further upsets the kayak's balance by acting as a sail. Fourth, once installed on a kayak, these designs stay employed even if weather conditions change during the course of an outing. Lastly, the current systems are kayak model specific thereby requiring a retailer to stock a large number of canopy devices so as to ensure product availability.

As such, there is a need for a kayak canopy which is selectively expandable or collapsible while also being quickly and easily mounted to/dismounted from a kayak deck (preferably without requiring the use of tools), utilizes a cover material which does not act as a sail when deployed, and is of a universal design so as to enable adoption of the canopy across an array of kayak designs or manufacturers. The present invention addresses these and other needs.

BRIEF SUMMARY OF THE INVENTION

In general, one embodiment the present invention is directed to a collapsible canopy apparatus removably mounted on a kayak. The canopy apparatus is expandable to provide shade to a kayaker upon demand, but can be collapsed when not needed. The canopy apparatus is releasably mounted onto brackets secured to the kayak deck such that the canopy apparatus can be removed when the kayak is being transported.

Preferably, an embodiment of a canopy apparatus for a kayak of the present invention comprises 1) a bracket configured to be mounted to a kayak deck and 2) a canopy. The canopy has a base member adapted to engage the bracket to releasably secure the canopy to the kayak deck. A canopy cover is pivotally connected to the base member and is selectively movable between collapsed and expanded positions.

In a further embodiment, the cover is constructed of a permeable fabric so as not to act as a sail.

In yet a further embodiment, the bracket includes a swivel mechanism whereby the bracket can selectively pivot such that substantially all of the base member rests upon the kayak deck.

In still a further embodiment, the bracket is mounted to the kayak deck with screws. And still further, elastic washers are secured between the screws and the bracket to ensure a watertight seal.

A further embodiment has a gasket located between the bracket and the kayak deck to further ensure a watertight seal.

Another embodiment includes a canopy having a plurality of ribs, wherein the cover is secured to the ribs through reinforcing panels.

In a further embodiment, the canopy further includes a locking mechanism coupled to the bracket to selectively control pivotal movement of the cover.

In yet a further embodiment, the forward edge of the cover is adapted to carry a plurality of lights. And more preferably these lights are light emitting diodes (LEDs). And still more preferably, these lights are water-proof solar powered lights.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
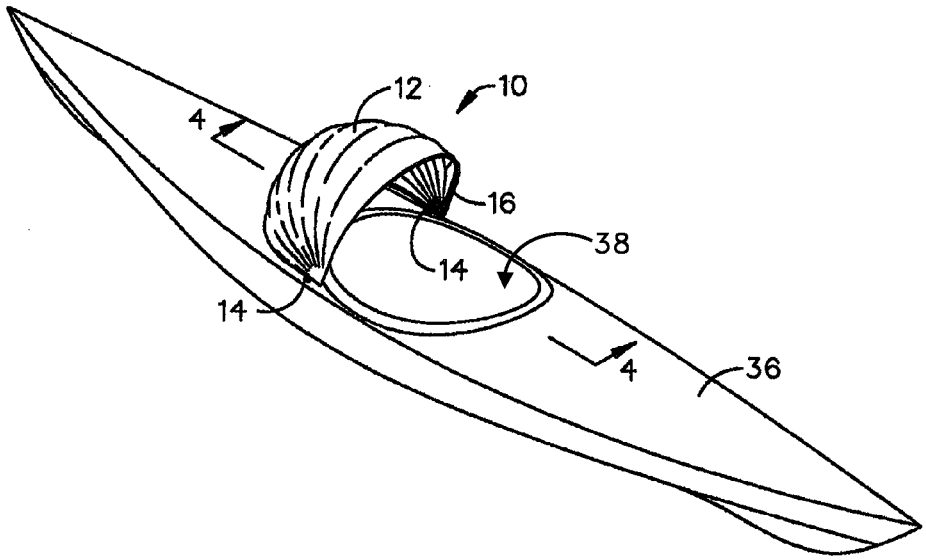
FIG. 1 is a perspective view of an embodiment of a canopy apparatus in accordance with present invention with the canopy in the open/expanded position.

Referring to the drawings in detail, and specifically to FIG. 1, an embodiment of a canopy apparatus in accordance with the present invention is generally indicated by reference numeral 10. Canopy apparatus 10 is mounted to kayak deck 36 by way of opposing brackets 14. Preferably, brackets 14 are positioned on the kayak deck 36 on either side of cockpit 38, and more preferably are position in the latter third of the opening of cockpit 38 (i.e. toward the stern of the kayak). In this manner, when the canopy 12 is in the fully expanded (opened) position, such as that shown in FIG. 1, forward edge 16 of the canopy extends the canopy to cover only a portion of the cockpit area. More preferably, the fully expanded canopy 12 covers that portion of the cockpit 38 which is situated above the head and/or shoulders of the kayaker seated within the cockpit. In this manner, a kayaker seated within the cockpit will not have his or her peripheral vision impeded by the canopy fabric, but will be protected from direct exposure to the sun should the sun be located directly overhead or behind the kayaker. In preferred embodiments, the fabric cover of canopy 12 is constructed of a permeable fabric which will allow breezes to pass through the cover fabric without generating drag or imparting a sail effect. More preferably, the permeable fabric is constructed of UV protective material and is fade resistant.

Figure 2:
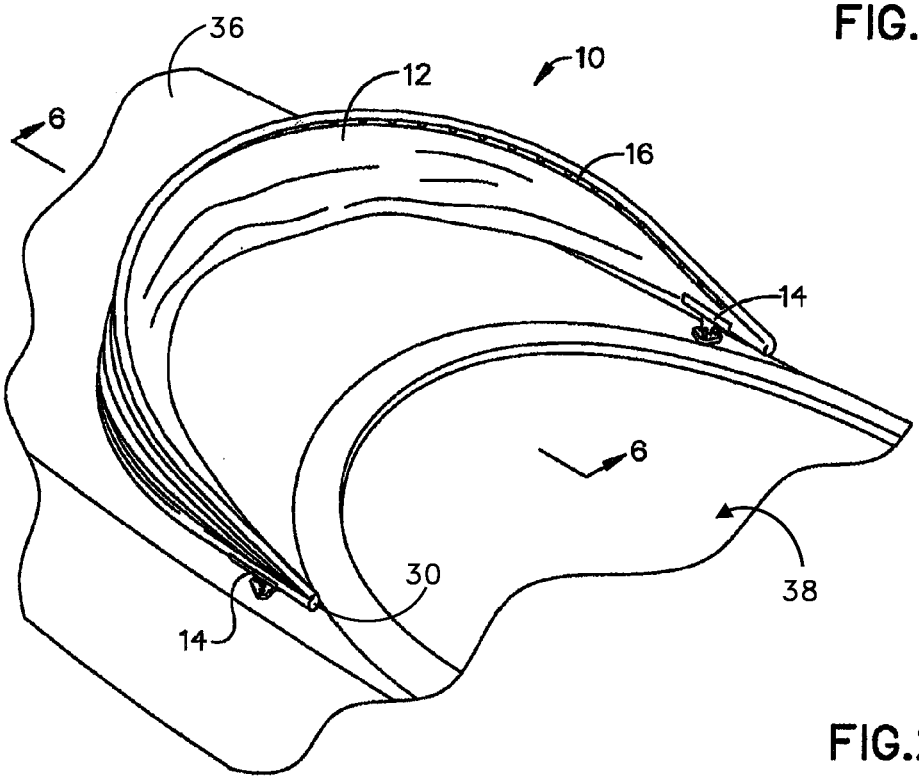
FIG. 2 is a detailed perspective view of a canopy apparatus in accordance with present invention, with the canopy in the collapsed position.
Figure 3:
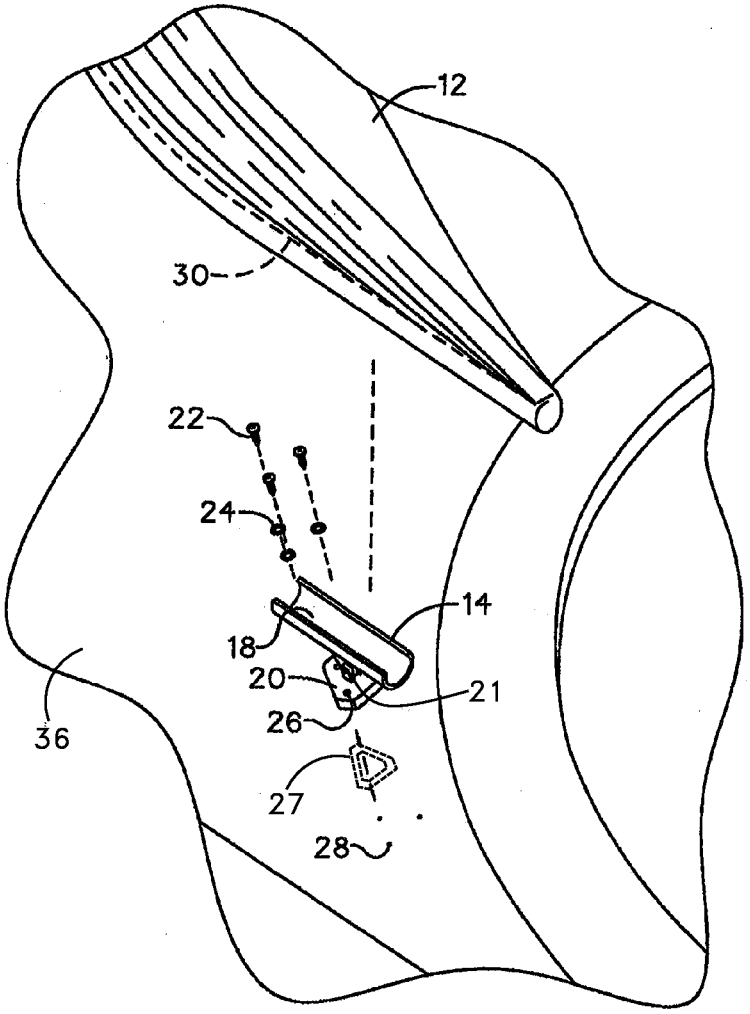
FIG. 3 is a detailed exploded view of a canopy apparatus in accordance with present invention.

Turning now to FIGS. 2 and 3, shown are detailed views of an embodiment of the canopy apparatus 10 with canopy 12 in the collapsed position. When in the collapsed position, the canopy 12 is situated behind cockpit 38 with forward edge 16 lying proximate the kayak deck 36. Canopy 12 includes a canopy base member 30 which is releasably secured within brackets 14. In a preferred embodiment, canopy base member 30 is a rigid yet flexible tube-like member formed into a generally C-shaped semi-circle or semi-ellipse. Canopy base member 30 is preferably rigid enough to maintain its structure but remain flexible enough such that the opening angle and/or distance between opposing ends may be flexibly adjusted so as to fit kayak decks/cockpits having different widths. In this manner, a single canopy (with flexible canopy base member) can be utilized by any number of differing kayak styles or designs.

As shown in an exploded view in FIG. 3, bracket 14 is a generally Y-shaped member comprised of a bracket base 20 and bracket channel 18 connected by a bracket post 21. In preferred embodiments, canopy base member 30 is proportioned so as to releasably seat within channel 18. Bracket channel 18 is preferably a tubular member having a generally C-shaped cross-section wherein opposing ends of the channel form a gap. More preferably, the width between the opposing ends of the channel forming the gap is slightly smaller than the internal diameter of the tube. Canopy base member 30 preferably has an outer diameter slightly larger than the gap formed between the opposing ends of the channel but slightly smaller than the inner diameter of the tube. In this manner the opposing ends of the open channel can flex outwardly to allow passage of canopy base member through the gap such that the canopy base member seats within the channel. The opposing ends can then relax, thereby contracting the gap opening and securing the base member within the bracket. To remove the base member, the kayaker will need to exert sufficient upward force on the canopy base member 30 so as to cause the opposing ends of bracket channel 18 to flex and widen the gap a sufficient degree to allow passage of the base member.

With continued reference to FIG. 3, bracket base 20 includes one or more mounting holes 26 through which pass bracket screws 22. Preferably, to prevent damage to the kayak deck 36 when mounting the brackets, kayak deck 36 includes complementary pilot holes 28 which accept bracket screws 22. To ensure a watertight seal, bracket screws 22 may carry elastic washers 24 which seal mounting holes 26 upon tightening of the screws. An additional, optional, watertight seal may be created using a gasket 27 which is sized to seat between bracket base 26 and kayak deck 36 upon mounting of the bracket. It is further envisioned that a watertight seal may be made using a caulk around the edges of the mounted bracket 14. In a preferred embodiment, bracket post 21 includes a locking swivel mechanism thereby allowing bracket channel 18 to rotate and/or pivot relative to the bracket base 20 which is secured to the kayak deck 36. In this manner, the bracket channel 18 can be oriented such that substantially all of the canopy base member 30 rests upon kayak deck 36. Thus, bracket 14 is able to accommodate kayaks having differently sloped deck bodies.

Figure 4:
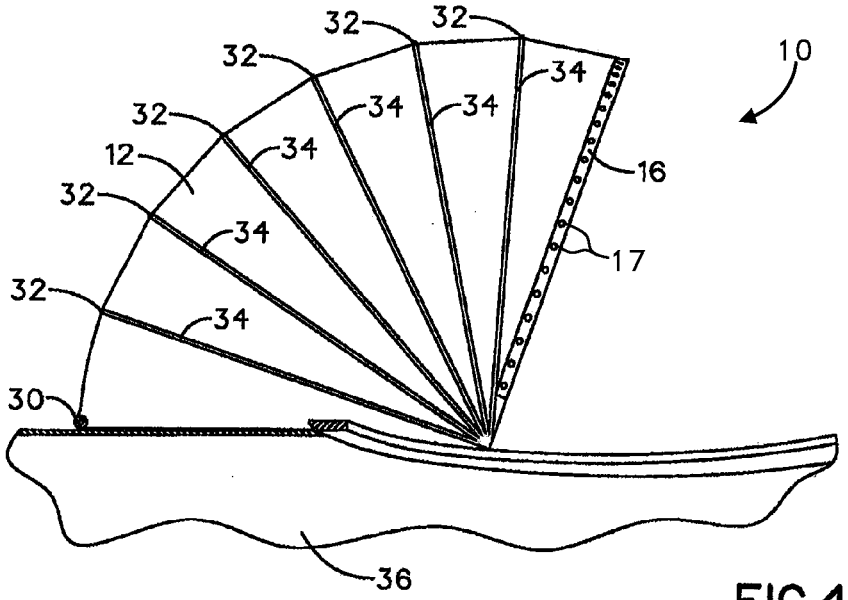
FIG. 4 is a section view of a canopy apparatus in accordance with present invention, taken along line 4-4 in FIG. 1.

A more detailed description of the operation of the canopy apparatus will be made with reference to FIGS. 4-6. FIG. 4 is a section view of a canopy apparatus 10 in accordance with present invention, taken along line 4-4 in FIG. 1, showing canopy 12 in the expanded position. As shown in FIG. 4, canopy 12 is secured proximate the kayak deck 36 at canopy base member 30. Respective distal ends of each of a plurality of canopy ribs 32 and forward edge 16 are pivotally secured to canopy base member 30 proximate the respective distal ends of the base member 30. In this manner canopy 12 extends in a generally arcuate manner by pivoting forward edge 16 over cockpit 38 (see FIG. 1) such that the canopy ribs 32 fan out and support the fabric cover of canopy 12. In a preferred embodiment, the forward edge and ribs are pivotally secured to the base member through a locking mechanism. This locking mechanism prevents, or at least inhibits, unintentional or unwanted expansion or collapsing of the canopy. That is, to adjust the degree of canopy opening, whether to be fully collapsed, fully expanded, or to an intermediate point, the kayaker must first unlock the mechanism to permit free pivoting of the forward edge/canopy ribs. Once the canopy is opened to the desired position, the locking mechanism is re-engaged thereby restricting any further pivoting of the canopy.

Figure 5:
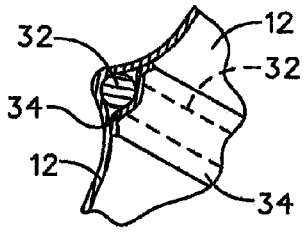
FIG. 5 is a detailed section view of a canopy employed by a canopy apparatus in accordance with present invention.

As shown in FIG. 5, each rib 32 is preferably supported within a dedicated reinforced rib pocket formed between canopy 12 and a reinforcing fabric panel 34. Collapsing of the canopy (as shown in FIG. 6) entails a generally stepwise collapse of the canopy ribs (and associated cover fabric 12) in an accordion-like manner. As such, canopy 12 is able to compactly collapse the forward edge 16 rearwardly so as to minimize any sight obstructions when the canopy is stowed.

Figure 6:
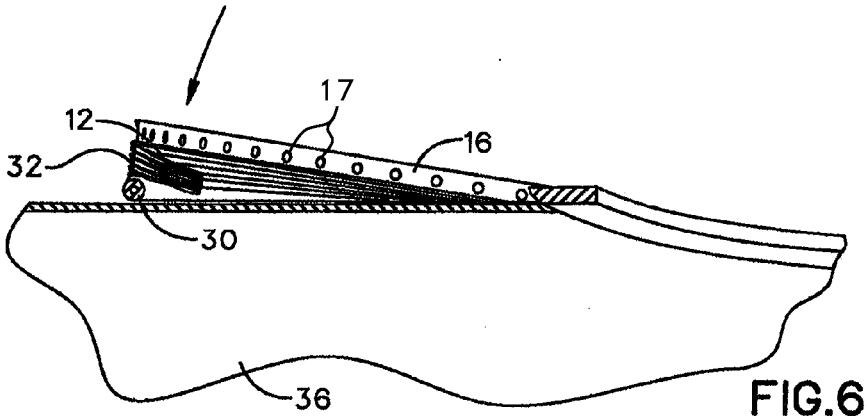
FIG. 6 is a section view of a canopy apparatus in accordance with present invention, taken along line 6-6 in FIG. 2, illustrating the canopy in the collapsed position.

Also shown in FIGS. 4 and 6 is a further enhancement to the canopy apparatus 10. In this embodiment, forward edge 16 is constructed of a water-proof light rope (with the fabric cover of canopy 12 secured thereto). The water-proof light rope is configured to carry a plurality of lights 17. In preferred embodiments, these lights are light emitting diodes (LEDs) and can be any color or combination of colors as selected by the kayaker. More preferably, the LED light rope is solar powered. To that end, it is envisioned that the canopy cover material may operate as the solar energy collector used to charge the LED device.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A canopy apparatus for a kayak comprising:

a) a generally Y-shaped bracket mounted to a kayak deck, said bracket having:

i) a bracket base for mounting said bracket to the kayak deck, ii) a bracket channel having a generally C-shaped cross section, and iii) a bracket post that connects said bracket base and said bracket channel, and b) a canopy having i) a base member that engages the bracket to releasably secure the canopy to the kayak deck, and ii) a cover pivotally connected to the base member, the cover being selectively movable between collapsed and expanded positions.

2. The canopy apparatus of claim 1 wherein said cover is constructed of a permeable fabric.

3. The canopy apparatus of claim 1 wherein said bracket post whereby the bracket can selectively pivot such that substantially all of the base member rests upon the kayak deck.

4. The canopy apparatus of claim 1 wherein said bracket is mounted to said kayak deck with screws.

5. The canopy apparatus of claim 4 wherein elastic washers are secured between said screws and said bracket.

6. The canopy apparatus of claim 1 wherein said canopy further includes a gasket between said bracket and said kayak deck.

7. The canopy apparatus of claim 1 wherein said canopy further includes a plurality of ribs, wherein said cover is secured to said ribs through reinforcing panels.

8. The canopy apparatus of claim 1 wherein said bracket post is coupled to said bracket to selectively control pivotal movement of the cover.

9. The canopy apparatus of claim 1 wherein said cover has a forward edge to carry a plurality of lights.

10. The canopy apparatus of claim 9 wherein said lights are light emitting diodes (LEDs).

11. The canopy apparatus of claim 9 wherein said lights are solar powered.

* * * * *